United States Patent [19]

Grutza

[11] 3,980,549

[45] Sept. 14, 1976

[54] METHOD OF COATING FORM WHEELS WITH HARD PARTICLES

[75] Inventor: Zigmund R. Grutza, Detroit, Mich.

[73] Assignee: Di-Coat Corporation, Detroit, Mich.

[22] Filed: Jan. 6, 1975

[21] Appl. No.: 538,713

Related U.S. Application Data

[63] Continuation-in-part of Ser. No. 388,152, Aug. 14, 1973, abandoned, which is a continuation-in-part of Ser. No. 156,090, June 23, 1971, Pat. No. 3,762,882.

[52] U.S. Cl. ..... 204/16; 204/25

[51] Int. Cl.[2] ..... C25D 15/00; C25D 15/02

[58] Field of Search ..... 204/16, 25, 272, 260

[56] References Cited

UNITED STATES PATENTS

| | | | |
|---|---|---|---|
| 2,194,546 | 3/1940 | Goddu et al. | 204/16 |
| 2,391,206 | 12/1945 | Van Der Ryl | 204/16 |
| 3,046,204 | 7/1964 | Barron | 204/16 |
| 3,587,358 | 6/1971 | Yoshino | 204/16 |
| 3,785,938 | 1/1974 | Sam | 204/16 |

*Primary Examiner*—T. M. Tufariello

*Attorney, Agent, or Firm*—Whittemore, Hulbert & Belknap

[57] ABSTRACT

The present invention relates to a process for forming an abrasive layer consisting of hard particles secured within a metallic matrix onto the outer rim of a grinding wheel. More specifically, hard particles such as particles of diamonds and cubic boron nitride are affixed onto the outer peripheral rim of a wheel by enclosing said rim in a ring or cover of stretchable porous material, confining said particles between said porous cover and the rim, and electrodepositing a metal matrix onto said rim in an electroplating bath to enclose said particles in the matrix.

3 Claims, 4 Drawing Figures

METHOD OF COATING FORM WHEELS WITH HARD PARTICLES

BRIEF SUMMARY OF THE INVENTION

This application is a continuation-in-part of United States application Ser. No. 388,152, filed Aug. 14, 1973 now abandoned, which is a continuation-in-part of United States application Ser. No. 156,090, filed June 23, 1971, now U.S. Pat. No. 3,762,882.

According to the present invention, there is provided a method for depositing hard particles, such as diamonds or cubic boron nitride particles, onto the outer peripheral rim of form grinding wheels. The method comprises placing the wheel in an electroplating bath containing a selected metallic salt, encasing the rim of the wheel onto which the hard particles are to be bonded in a ring or cover of porous stretchable natural or synthetic fibrous material, confining the particles in the space defined by the rim of the form wheel and the cover, and passing an electric current through said bath to deposit a matrix of said metal onto the wheel, said metal being deposited onto the rim of the wheel and holding and trapping said particles to the rim.

DETAILED DESCRIPTION

Figure 1:
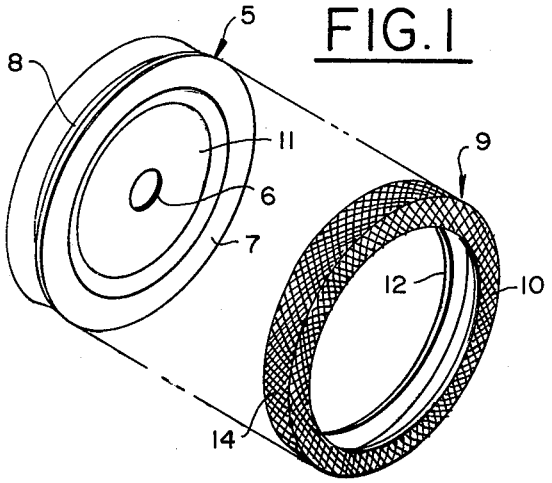
FIG. 1 is an exploded perspective view, in accordance with the invention of a form wheel and a stretchable porous ring or cover of natural or synthetic fibers.
Figure 2:
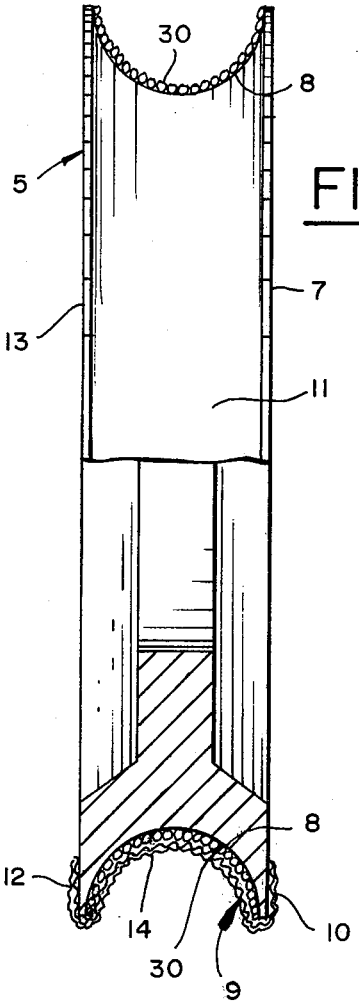
FIG. 2 is a view partly in elevation and partly in section showing in the sectional portion of the view hard particles held against the concave work surface of a form wheel by the porous ring. In the elevational portion, the hard particles have been omitted except at the top and the porous ring has been omitted altogether.
Figure 3:
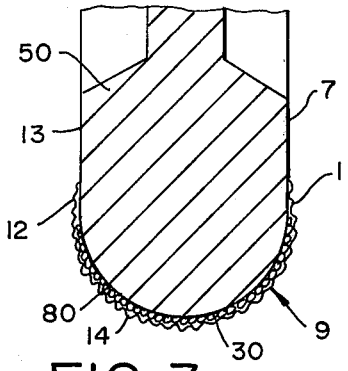
FIG. 3 is a fragmentary sectional view similar to FIG. 2 in which the work surface of the wheel is convex.

The present invention makes it possible to obtain an even layer of abrasive particles on the work surface of the tool, in this instance shown as a form grinding wheel. In the process of the present invention a layer of abrasive particles 30 is affixed to the outer work surface or periphery 8 of the form grinding wheel 5. The wheel may be of any metal which is capable of being electroplated, such for example as steel or brass. As shown in FIGS. 1 and 2, the form wheel 5 has a body 11 in the form of a flat circular disc having two sides 13, 7, a centrally disposed arbor hole 6, and a concave peripheral outer work surface or rim 8 to which are affixed abrasive particles 30. Instead of having a concave work surface 8, as shown in FIGS. 1 and 2, the wheel 50, as shown in FIG. 3, may have a convex work surface 80. The size of the particles has been greatly and disproportionately exaggerated in the drawings so that the steps of the process for affixing the abrasive particles to the tool may be made clear. It is to be understood that the particles employed will vary somewhat in size, depending on the purpose for which the took is to be employed, but will generally be in the range of from about 20 to 350 mesh.

In the practice of the invention, a porous flexible ring or cover 9 is fashioned to assume a generally annular form. Preferably, it is U-shaped in cross-section, more or less like a pneumatic automobile tire casing, having an axially extending annular portion 14 and annular side flanges 10 and 12 extending radially inwardly from portion 14. This cover 9 is applied to the form wheel 5. The cover 9 is made of a material which is knit or woven from natural or synthetic fibers. The material is preferably elastic and should desirably stretch somewhat in at least one and preferably both circumferential and transverse directions. In its natural, free or unstretched condition, the portion 14 of cover 9 is preferably somewhat smaller in diameter than the wheel rim at its smallest point, and also somewhat narrower than the width of the wheel rim. Due to the fact that the material is preferably elastic and stretchable in both longitudinal and transverse directions, the cover 9 hugs to and assumes the contour of the work surface of the form wheel, as shown in FIG. 2. Examples of materials that can be used are polyester, nylon, silk, rayon, cotton, wool and the like. With materials like cotton, wool and others which are not elastic per se, combinations of these materials woven or knit with elastic materials, which fabrics are available commercially, can be used. A polyester double knit is preferred, which is elastic and stretchable both circumferentially and axially.

The cover 9 must be porous enough to admit the free circulation of the bath, and the metal ions, therethrough, but not so porous that it will let the abrasive particles escape. In other words, the pores of the fabric should be smaller than the abrasive particles. The porosity of the fabric referred to is that condition produced by the spaces between the fibers of material formed by knitting or weaving into a particular fabric.

In accordance with a preferred procedure, the wheel is first cleaned and then immersed in an electroplating bath, after which time the cover 9 is applied over the outer periphery of the immersed wheel. Abrasive particles 30 are thereafter inserted between the cover 9 and the work surface 8 of the immersed wheel. Preferably the abrasive particles are mixed in a beaker with some of the electroplating solution to form a slurry of abrasive stones which then is spooned into the space between the cover 9 and the periphery of work surface of the wheel. The immersed wheel as shown may be placed on the bottom of the tank 30 in a horizontal position in which it is fully immersed in but only slightly below the surface of the electroplating bath so that the slurry of stones can be easily spooned into the space between the cover and the wheel. The envelope formed by the cover 9 and the work surface 8 is packed full of the abrasive particles. The abrasive particles are then smoothed out while the wheel remains immersed to form an even distribution over the concave work surface. This can be done, among other ways, most simply by pressing and rubbing, as with a finger, on the cover 9 at its outer peripheral surface 8 to smooth out any uneven distribution of the particles, which uneven distributions appear as lumps in the outer peripheral surface 8 of the cover 9.

Figure 4:
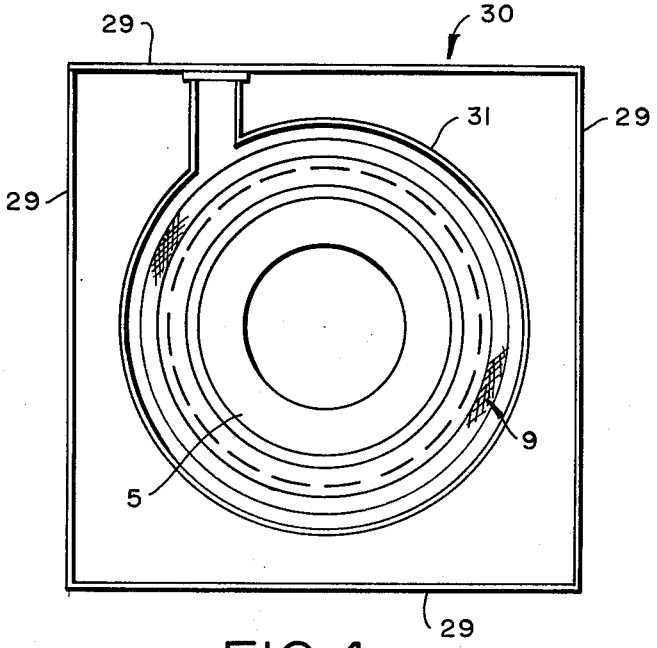
FIG. 4 is a top plan view of a form wheel with hard particles held against the wheel periphery by the porous ring, shown in a plating tank.

It has been found that an anode which extends substantially around the form wheel, which acts as the cathode in the plating bath, gives the best results as far as having an even deposit of the plating metal on the work surface of said wheel is concerned. The anode 31 shown in the embodiment of FIG. 4 is substantially annular in shape and is formed substantially of the metal, such as nickel, which is to be electroplated onto the work surface of the form wheel. When the form wheel 5 is placed in the electroplating bath in a position such that the anode 31 concentrically surrounds it, the bath is electrolyzed with externally applied current of sufficient density to electrolytically deposit the metal ions, such as nickel — which are present in the bath in the form of the nickel salt, i.e., nickel sulfate, and present in the anode as nickel metal — onto the work surface. As the metal is deposited from the bath onto the work surface it traps and holds the abrasive particles held in place by cover 9 against the work surface until eventually there is formed on the surface of said work surface a metal matrix having included therein the abrasive particles. The areas of the form wheel which are not to be plated, such as the sides 7, 13 can if desired be masked with a suitable masking material prior to the plating process. This masking material can be removed after plating has been carried out.

After the metal matrix has been built up to a sufficient depth the form wheel 5 is removed from the plating tank and the cover 9 is removed from the wheel. In most cases the build up of the metal matrix is continued until about 75% of the area of the abrasive particles is covered by the metal. The time required to do this will depend, to a large extent, upon the size of the abrasive particles used. The smaller the particles, the shorter the plating time required to cover the desired proportion of the abrasive particles with the matrix metal. During the plating process the bath can be either agitated, as by mechanical means or by passing air therethrough, or kept quiescent. Often the finer abrasive sizes become tightly packed and agitation is desirable to cause the bath to penetrate the abrasive pack. Larger particle sizes do not require agitation and in fact too much agitation can cause shifting of the particles and retardation of bonding. If the particle size is large enough so that the bath penetrates properly, it is preferred to keep the bath quiescent.

In another embodiment of the invention, the step of packing the envelope formed by the fabric cover 9 and the work surfaces 8 with abrasive particles can be eliminated. In this embodiment the interior of the outer peripheral surface 14 of the fabric cover is first coated with an adhesive, such as a pressure sensitive spray adhesive manufactured by the Minnesota Mining and Manufacturing Corporation under the name "Shipping Mate". The abrasive particles are then sprinkled onto this adhesive coated surface and adhere thereto. The fabric cover 9 is then applied over the periphery of the wheel while the wheel is immersed in the plating tank 30 and the electroplating process is carried out in the previously described manner.

If desired, the cover 9 is transversely severed at one point so that it is initially in the form of a strip rather than an annulus. The ends of the strip may have adhesive tabs or tabs of "Velcrose" cloth so that the strip can be stretched around the periphery of the immersed wheel and held thereon by adhering the tabs together. Such a strip-form cover made into annular form can be used in both embodiments of the invention above described, that is where the abrasive is packed between the cover and the wheel after the cover is applied or where the abrasive is initially adhered to one surface of the cover and the cover is thereafter applied to the wheel.

After the metal matrix has been electrodeposited onto the work surface 8 of the form wheel, the wheel is removed from the tank and the cover 9 is stripped from the wheel. The abrasive particles are held more tightly in the metal matrix than by the adhesive to the cover 9. Therefore, upon removing the cover 9 from the wheel the abrasive particles will remain in the metal matrix rather than coming away with the cover 9. The wheel can then be washed in a suitable solvent, such as acetone, to remove any of the adhesive which remains adhered to the exposed surfaces of the abrasive particles.

The particles used are preferably diamond particles or cubic boron nitride particles. The diamond and cubic boron nitride particles can range in size from 20 to 350 mesh. Smaller sizes of particles may be desired, i.e., up to 600 mesh. Whatever the size, it is necessary to use a fabric having smaller spaces between the fibers thereof, to prevent the particles from slipping out through the spaces in the fabric. A porous cover made of silk screen may be used for very small particles. Natural or synthetic diamonds may be used. Particles of cubic boron nitride, also referred to as Borazon, are obtained from crystals of the cubic form of boron nitride which are in turn prepared by subjecting a hexagonal form of boron nitride to high pressures of about 50,000 atmospheres and high temperatures of at least 1200°C. in combination with a catalyst material.

If the particles used are Borazon particles, and the matrix metal to be electrodeposited is nickel, the electrodeposition may be carried out in a plating tank 30 containing a plating bath which may comprise about 60–65 ounces per gallon of $NiSO_4$, about 12–15 ounces per gallon of $NiCl_2$, about 6 ounces per gallon of $H_3BO_3$. Nickel metal is 15 ounces per gallon and a pH of about 3.4–4. The anode 31 consists of nickel and is substantially annular, extending substantially concentrically around the wheel and being in the same plane, i.e., horizontal, as the wheel. With the use of a substantially annular anode the current density is quite even along the entire circumference of the wheel i.e., along the entire 360° of working surface 8. This results in an even deposit of nickel matrix without the necessity of having to rotate or in any way move the wheel. Plating may then be carried out at from about 0.8 to about 1.2 volts. Plating is carried on until the desired depth of metal matrix is built up.

If the particles used are diamond particles and the matrix metal which is to be electrodeposited is nickel, the electrodeposition may be carried out in a plating tank 30 containing a plating bath which may comprise about 40–60 ounces per gallon of $NiSO_4$, about 5–10 ounces per gallon of $NiCl_2$ and about 5–6 ounces per gallon of $H_3BO_3$. Otherwise the procedure may be as described in the preceding paragraph.

The following examples set forth preferred methods of practicing this invention:

EXAMPLE 1

A wheel 5, which was first cleaned, was placed on the bottom of a plating tank 30 on its side in horizontal position immersed in a plating bath, as in FIG. 3.

An elastic polyester double knit fabric was formed into a cover 9 having a substantially annular shape as shown in FIG. 1. This cover 9 was placed over the concave outer rim or work surface 8 of the immersed wheel 5. This double knit fabric had two-way stretch, i.e., the cover stretched along the circumferential direction of the outer peripheral portions 14 and axially or transversely of the length of said portion 14. The cover in its unstretched condition was smaller in diameter than the rim 8 at its smallest point, and was narrower than the wheel. Thus, the cover at its outer peripheral portion 14 stretched and assumed the concave shape of the work surface 8. The cover stretched differentially, that is different amounts, across its width so as to hug the entire concave surface 8. Diamond particles of a grit size of about 50 mesh were then mixed with some of the electroplating solution or bath to form a slurry which was introduced and packed between the cover 9 and the work surface 8. This was accomplished by raising side flange 10 of the cover and spooning the slurry of diamond particles between the work surface 8 of the immersed wheel 5 and the portion 14 of the cover 9. The wheel was close to the surface of the plating solution to facilitate introduction of the slurry of abrasive between the wheel periphery and the cover. This process of raising side flange 10 and packing the diamond particles into the envelope formed by portion 14 and work surface 8 was repeated until the entire 360° of work surface 8 had diamond particles packed adjacent thereto. External pressure was then applied to the top of surface portion 14 to smooth out any uneven concentration or build-up of free diamond particles that may have occurred during the packing process thereby evenly distributing the diamond particles over the work surface 8.

A nickel anode 31 in the tank, substantially circular in shape, was disposed substantially concentrically around the wheel. The plating bath contained about 40–50 ounces per gallon of $NiSO_4$, 5–6 ounces per gallon of $NiCl_2$, 5–6 ounces per gallon of $H_3BO_3$, and a pH of 3–6. Plating was carried out and continued until the nickel deposit had built up to an extent sufficient to cover about 75% of the average diamond particle. During the plating process the bath was agitated so that there was a constant movement of the bath solution about the wheel. After plating was terminated the wheel was removed from the bath, the cover 9 was stripped from the wheel, and the wheel was washed.

EXAMPLE 2

An elastic nylon fabric was formed into a cover 9 having a substantially annular shape as shown in FIG. 1. The interior of this cover, particularly the interior of portion 14, was sprayed with a spray adhesive, specifically "Shipping Mate Spray Adhesive" manufactured and sold by The Minnesota Mining and Manufacturing Corporation. Borazon particles having a grit size of about 100 mesh were then sprinkled onto the interior of portion 14 until said surface was entirely covered with said Borazon particles. The cover was then stretched over a cleaned form wheel 50 having a work surface 80 of a convex shape while the wheel was on its side in horizontal position in tank 30 immersed in a plating bath as in FIG. 3. A nickel anode 31 of substantially circular shape was disposed concentrically around said wheel. The plating bath consisted of about 60 ounces per gallon of $NiSO_4$, about 12–15 ounces per gallon of $NiCl_2$, about 6 ounces per gallon of $H_3BO_3$, and about 15 ounces per gallon of nickel. This high electrolyte bath allowed plating at higher current densities than is possible with a bath having a low electrolyte content, thus allowing the plating time to be substantially reduced. After the nickel deposit had built up to a depth sufficient to cover about 75% of the average Borazon particle, plating was terminated and the wheel was removed from the bath. The cover 9 was stripped from the wheel and the wheel was washed in an organic solvent, such as acetone, to remove any adhesive remaining adhered to the Borazon particles. The wheel was then washed a second time in water.

The preferred metal matrix is one consisting essentially of nickel. However, other metals can be used for the matrix. Among these metals are those that are used in the more common types of plating baths: antimony, bismuth, cadmium, chromium, cobalt, copper, gold indium, iron, lead palladium, platinum, silver, tungsten, tin and zinc.

As mentioned above, the cover 9 is easy to use if it has an annular shape with radially extending side flanges or walls 10, 12 and if the fabric from which it is made is elastic or stretches in at least one direction. However, for the purposes of the present invention, the cover 9 need not have said specified annular shape. It can be, for example, merely a length of fabric preferably U-shaped in cross-section which can be used to encompass the rim of the form wheel and the two ends of said fabric can then be joined together as by staples, stitches, adhesives, adhesive or Velcrose cloth tabs, or other like means to form an annulus. Furthermore, although it is preferable that the fabric of the cover 9 be elastic or stretchable in at least one direction to a certain degree, this property is not mandatory. Thus a plain cloth preferably of U-shaped cross-section and made of cotton can be placed around the rim of wheel 5 and drawn taut until it generally follows the contours of the work surface 8 or 80. The two edges of said cloth can then be joined together and held fastened to each other as by means of an adhesive.

An annular cover is considered easier to apply to the wheel, but a strip-form cover has the advantage of being capable of being laid out flat so that abrasive may be initially adhered to one surface thereof.

Although best results are obtained if the anode is of substantially circular shape, as shown in FIG. 4, it is to be understood that the anode need not be of that shape in the practice of the present invention. Thus, for example, the anode can be substantially of a rectangular or square shape, or for that matter any polygonal or any annular shape, surrounding the form wheel. As a matter of fact, the anode need not even substantially encompass or extend around the form wheel but can be simply a bar at one end of the tank or a strip of metal extending along one side of the tank.

What I claim as my invention is:

1. A method of forming an abrasive layer of hard particles secured in a metal matrix on the annular peripheral surface of a grinding wheel comprising, providing an annular cover of flexible, resilient, porous, woven material capable of two-way differential stretching and the minimum diameter of which when unstretched is less than the minimum diameter of said peripheral surface so that when stretched over said peripheral surface said cover will follow the transverse as well as the circumferential contour thereof, retaining said particles about said peripheral surface by stretching said cover over said peripheral surface so that said stretched cover resiliently presses said particles against said peripheral surface, and, while said particles are held against said peripheral surface by said cover as aforesaid, depositing a matrix of said metal onto said peripheral surface to hold said particles in said matrix by making said wheel a cathode in an electroplating bath of the matrix metal and electrolyzing said bath.

2. The method defined in claim 1, wherein said particles are selected from the group consisting of diamonds and boron nitride.

3. The method defined in claim 1, wherein said cover is formed of a double-knit fabric.

* * * * *